United States Patent [19]

Lynde et al.

[11] Patent Number: 5,038,859

[45] Date of Patent: Aug. 13, 1991

[54] CUTTING TOOL FOR REMOVING MAN-MADE MEMBERS FROM WELL BORE

[75] Inventors: Gerald D. Lynde; Harold H. Harvey, Jr., both of Bossier City, La.

[73] Assignee: Tri-State Oil Tools, Inc.

[21] Appl. No.: 290,575

[22] Filed: Dec. 27, 1988

Related U.S. Application Data

[63] Continuation-in-part of Ser. No. 181,812, Apr. 15, 1988, Pat. No. 4,978,266, which is a continuation-in-part of Ser. No. 816,287, Jan. 6, 1986, Pat. No. 4,796,709.

[51] Int. Cl.[5] ..... E21B 29/00

[52] U.S. Cl. ..... 166/55.6; 175/403; 175/398; 408/144; 408/203.5

[58] Field of Search ..... 166/55.6, 55.7; 408/703, 203.5, 713, 59, 79-82, 111, 144, 145, 213, 227, 229, 204, 205, 206; 407/32, 2, 6, 118, 119, 62, 66, 100, 116; 144/205; 175/374, 375, 402, 403, 398; 82/4 C; 76/108 A, 108 J, DIG. 11, DIG. 12

[56] References Cited

U.S. PATENT DOCUMENTS

| | | | |
|---|---|---|---|
| 2,328,494 | 5/1942 | Reaney . | |
| 2,337,322 | 12/1943 | Gascoigne | 407/118 |
| 2,709,490 | 5/1955 | Trimble . | |
| 2,846,193 | 8/1958 | Chadderdon | 255/73 |
| 2,999,541 | 9/1961 | Kinzbach et al. | 166/55.7 |
| 3,110,084 | 11/1984 | Kinzbach | 29/105 |
| 3,114,416 | 12/1963 | Kammerer | 166/55.7 |
| 3,145,790 | 8/1964 | Bridwell et al. | 76/108 R |
| 3,147,536 | 9/1964 | Lamphere et al. . | |
| 3,726,351 | 4/1973 | Williams, Jr. | 175/403 X |
| 4,218,162 | 8/1980 | Hillier | 408/713 |
| 4,274,769 | 6/1981 | Multakh | 408/204 X |
| 4,440,247 | 4/1984 | Sartor | 175/403 X |
| 4,500,234 | 2/1985 | Orth et al. | 408/206 |
| 4,591,303 | 5/1986 | Sato et al. | 408/206 |
| 4,710,074 | 12/1987 | Springer | 175/325 X |
| 4,717,290 | 1/1988 | Reynolds et al. | 407/34 |

FOREIGN PATENT DOCUMENTS

| | | | |
|---|---|---|---|
| 156235 | 3/1984 | European Pat. Off. . | |
| 0530941 | 12/1976 | U.S.S.R. | 175/403 |
| 0791890 | 12/1980 | U.S.S.R. | 175/403 |

*Primary Examiner*—Z. R. Bilinsky

*Attorney, Agent, or Firm*—Dodge Bush & Moseley

[57] ABSTRACT

A cutting tool (10) for removing metal tubular members held in stationary position downhole from a well bore and adapted to be inserted within a well. The cutting tool (10) includes a plurality of elongate blades (32,34) on the cylindrical body (22) of the cutting tool (10) which extend below the bottom of the tool body (22). Cutting elements (42) of a predetermined size and shape are arranged in a symmetrical predetermined pattern on the lower portion of each blade (32,34) in a plurality of predetermined transversely extending rows below the tool body (22). The cutting elements (42) in adjacent transverse rows for each blade (32) are staggered horizontally and have different concentric cutting paths. Preferably, the cutting elements (42) in corresponding transverse rows on adjacent blades (32,34) are staggered and have different concentric cutting paths. Each cutting element (42) has a groove (42F) for receiving and directing forwardly the extending end of a metal shaving (S) to facilitate breaking thereof from the upper end of the tubular member (14) being cut away. A high strength tungsten carbide alloy material (41) is secured to the trailing surface of the blades (32,34) to reinforce the blades in addition to assisting the cutting action.

21 Claims, 6 Drawing Sheets

CUTTING TOOL FOR REMOVING MAN-MADE MEMBERS FROM WELL BORE

CROSS REFERENCE TO RELATED APPLICATIONS

This application is a continuation-in-part of copending application Ser. No. 181,812 filed Apr. 15, 1988, Pat. No. 4,978,266 entitled "Improved Cutting Tool for Removing Materials from Well Bore", which is a continuation-in-part of copending application Ser. No. 816,287, filed Jan. 6, 1986, Pat. No. 4,996,709 entitled "Milling Tool for Cutting Well Casing".

BACKGROUND OF THE INVENTION

This invention relates generally to a cutting tool for removing stationary man-made objects or tubular materials downhole from a well bore, such as packers stuck downhole, cemented casing, cemented tubing inside casing, cement aggregates, jammed tools or the like, and more particularly, to such a cutting tool having at least a portion of the blades extending from the bottom of the tool body and being inserted within a well bore for removing the members by first reducing the members to turnings or small chips for removal from the well by drilling fluid.

Heretofore, cutting tools have been provided with blades having at least a portion of the blades extending from the bottom of the tool body for cutting away a stationary object in a well bore such as a packer or cemented casing. However, such prior blades have been formed with tungsten carbide cutting fragments or chips embedded in a random pattern in a matrix formed of a suitable powder metallurgy composite material such as sintered tungsten carbide in a cobalt matrix to provide the cutting surface, and the cutting elements heretofore have not been arranged or constructed to provide a "chip breaker" action. As an example of such a cutting tool, rotary shoes having blades extending from the bottom and side of the tool body and utilizing crushed tungsten carbide particles in a matrix have been used in cutting away packers stuck downhole in a stationary position. However, particularly when the packers have been formed of a high strength corrosion resistant alloy steel, a glaze or work hardened surface is formed when being cut by such rotary shoes which is difficult to cut further and results in an abnormally low rate of penetration for the cutting tool.

Milling or cutting tools heretofore having blades extending from the tool body and formed with the tungsten carbide chips embedded in a matrix have normally utilized blades for taking a relatively small thickness bite from the man-made stationary metal object to be removed which provides a conglomeration of shapes and sizes of metal turnings ranging from fine hair-like turnings to curlings of around 6 inches in length, for example. Such turnings tend to curl and internest with each other to provide a so-called "bird nest" or mass which is difficult to remove from the well bore by drilling fluid after being cut from the metal object. The critical factor in obtaining a high rate of penetration is in the removal of the metal scrap material and oftentimes the limiting factor in the cutting operation is the rate of removal of the metal scrap material. Long relatively thin turnings or shavings tend to restrict such removal rates by internesting and wrapping around the drill string. The utilization of cutting elements or chips in a random pattern provides a non-uniform cutting action and this likewise tends to restrict the rate of cutting or milling away of the stationary object downhole.

SUMMARY OF THE PRESENT INVENTION

Copending application Ser. No. 816,287, filed Jan. 6, 1986, and copending application serial number 181,812, filed Apr. 15, 1988, relate to cutting tools which are inserted within a well for removing predetermined stationary members by first reducing the members into metal turnings or small chips for removal from the well by drilling fluid.

The improved cutting tool comprising the present invention has a plurality of blades on a tool body with at least a portion of the blades extending from the bottom of the tool body for cutting or milling predetermined man-made stationary objects directly beneath the tool body. The blades, in addition, may extend within the central bore of a tool body in addition to extending laterally outwardly from the tool body. Some of the blades may extend inwardly past the longitudinal centerline of the tool body so that any boring effect which might be provided at the vertical center of the tool body will be minimized or eliminated which may be desirable when the member to be removed is of a relatively small diameter and is positioned in alignment with the longitudinal centerline of the tool body.

Each of the blades comprising the present invention has a plurality of closely spaced cutting elements secured to the leading surface of the blade base, each cutting element being of a predetermined size and shape and arranged in a predetermined generally symmetrical pattern on the base, the cutting elements being arranged in transversely extending rows on each blade with the cutting elements in corresponding transverse rows on adjacent blades being offset horizontally so that different concentric cutting paths of the cutting elements on adjacent blades are provided during the entire cutting operation. Likewise, the cutting elements on adjacent transverse rows on each of the blades are offset horizontally so that different concentric cutting paths of the cutting elements on the same blade are provided on adjacent transversely extending rows.

In addition, the front cutting face of each cutting elements is arranged and constructed to provide a "chip breaker" action for effecting a breaking or turning of the material being cut from the metal member thereby to provide a relatively short length chip or turning as well as providing a chip or turning of a relatively large thickness to minimize internesting of the metal scrap material.

The arrangement of such cutting elements on the leading face of the blade as set forth above provides a uniform smooth cutting action which results in a formation of relatively short length and relatively thick turnings or chips normally having a length less than around two inches thereby to permit an efficient removal of scrap material from the well bore by a drilling fluid with a minimum of internesting of scrap material as was common heretofore. Such a smooth and uniform cutting action provides a rate of penetration for the removal of man-made stationary objects downhole from the well bore that is unexpected as compared with rates of penetration heretofore for prior art tools.

The leading surface of each blade is defined by a plurality of cutting elements which are arranged in generally transverse rows on the blade with each row preferably having at least two carbide cutting elements therein and being staggered with respect to adjacent rows. The hard carbide cutting elements are secured, such as by brazing, to the base or body of the blade and form the lower cutting surface which digs or bites into the extending upper end of the object to be removed. The carbide cutting elements and the supporting base of the blade wear away from the extending lower end of the blade as the cutting operation continues with successive rows of cutting elements being presented for cutting the subjacent object. The blade is preferably formed of a mild steel material substantially softer than the hard carbide cutting elements so that any drag from the wear flat formed by the blade base contacting the extending end of the object being removed is minimized. A depth of cut or bite taken by each blade is between around 0.002 inch to 0.005 inch and such a relatively large thickness of turning or cutting results in a short length which restricts curling or rolling up of the cutting thereby making the turnings easy to remove from the well.

A long life blade minimizes the number of trips in and out of the bore hole required for replacement of the tool or blades. The cutting elements are precisely positioned on each blade in an aligned relation with the other cutting elements of a similar shape and size. The leading face of each of the cutting element preferably has a negative axial rake with respect to the axis of rotation. The inclination obtained by the negative axial rate aids or assists in turning or directing the upper end of the metal chip or turning in a forward and downward direction in order to aid in a breaking off of the chip. The leading face of each cutting element, particularly if a negative axial rake is not provided, may be formed with an irregularity therein, such as a recess or groove which would further direct a metal turning or chip forwardly for breaking off a relatively small length metal chip from the upper end of the object being removed.

It is object of this invention to provide a cutting tool for removing a man-made member held in a stationary position downhole from a well bore by having blades on the tool body extending downwardly from the tool body for engaging and reducing the metal member being removed into turnings or small chips for subsequent removal by drilling fluid.

It is a further object of the present invention to provide such a cutting tool having such cutting blades with cutting elements of a predetermined size and shape arranged in a predetermined pattern in generally transverse rows on each blade with the cutting elements on each row being staggered horizontally with respect to the cutting elements on adjacent rows thereby to provide different cutting paths for adjacent rows of cutting elements.

An additional object is to provide such an improved cutting tool in which the blades extend downwardly from a lower end of the tool body and inwardly from the outer periphery of the tool body to a position past the longitudinal centerline of the tool body for effectively cutting tubular members which when milled, tend to center themselves on the contacting face of the tool.

Other objects, features, and advantages of this invention will become more apparent after referring to the following specification and drawings.

DESCRIPTION OF PREFERRED EMBODIMENTS OF THE INVENTION

Figure 1:
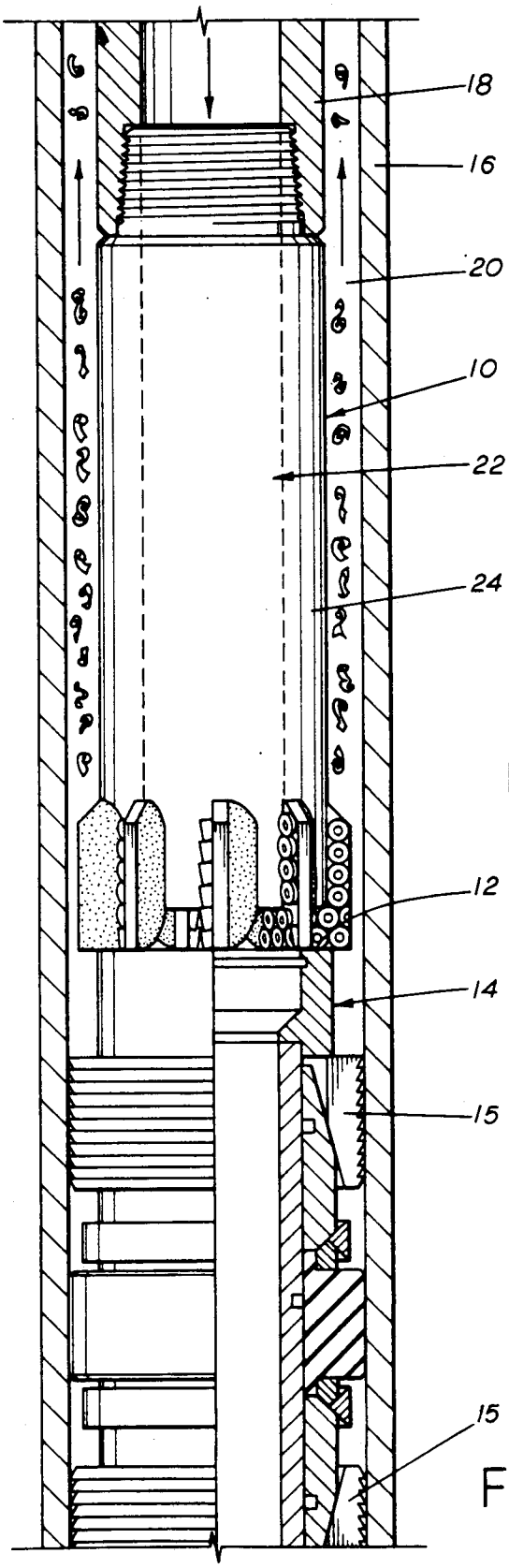
FIG. 1 is a longitudinal section of one embodiment of the cutting tool comprising the present invention having blades thereon extending below the lower end of the tool body and engaging the upper end of a packer stuck in the casing for removing the packer by first reducing the packer to metal chips or turnings.
Figure 4:
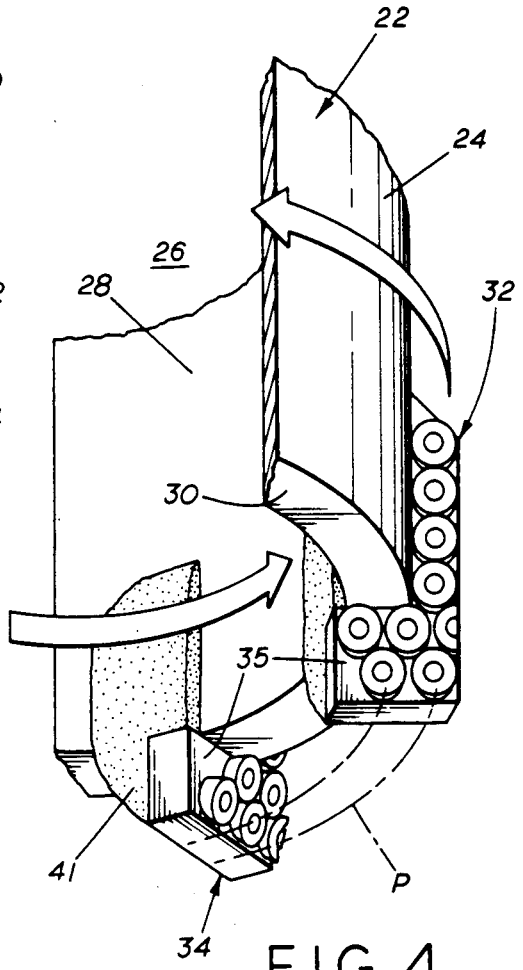
FIG. 4 is a perspective of a portion of the lower end of the cutting tool showing the cutting paths of a pair of adjacent blades with the cutting elements on adjacent blades being staggered horizontally for taking different concentric cutting paths.
Figure 2:
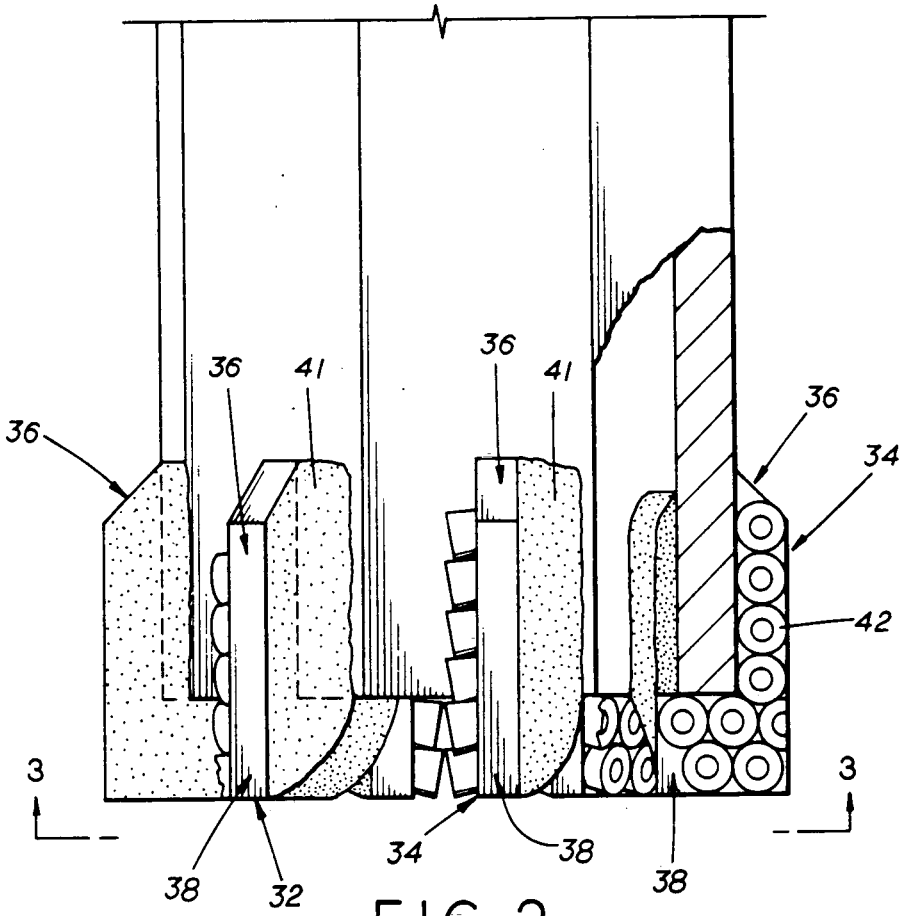
FIG. 2 is an enlarged elevation of the lower end of the cutting tool with a portion of the tool body broken away to show one of the blades in front elevation.
Figure 3:
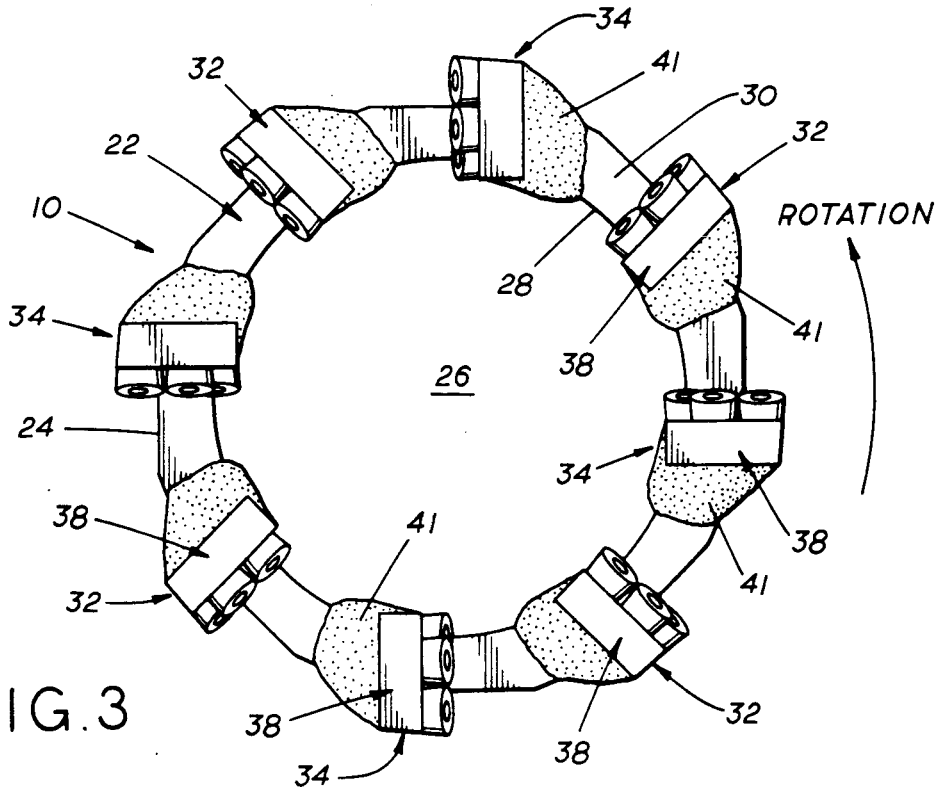
FIG. 3 is a bottom plan view looking generally along the line 3—3 of FIG. 2 and showing the blades arranged about the lower end of the tool body.

Referring now to the drawings for a better understanding of this invention, and particularly FIGS. 1–6 in which one embodiment of the present invention is illustrated, a milling or cutting tool comprising the present invention is illustrated generally at 10 and is adapted for cutting or milling away the annular end 12 of a stuck packer generally indicated 14 having slips 15 gripping the inner periphery of an outer casing 16 of a well. Milling tool 10 is connected at its upper end to a drill string 18 supported from the surface for rotation by suitable power means, as well known, which is also adapted to apply a predetermined loading on tool 10. Drilling fluid is supplied through the bore of drill string 18 and is returned to the surface through annulus 20 along with the scrap material from the cutting operation. Milling or cutting tool 10 has a cylindrical body 22 which defines an outer peripheral surface 24.

Milling tool 10 has a central bore 26 therein which defines an inner peripheral surface 28 and is adapted to receive drilling fluid from drill string 18 pumped from the surface for discharge from the annular lower end 30 of tool 10. The discharged drilling fluid removes the metal cuttings, chips, twinings, or metal scrap material resulting from the cutting operation from annulus 20 outside milling tool 10 by flushing the scrap material to the surface for disposal.

An important feature of the present invention is the improved blade design which is designed to provide a maximum cutting action with minimal loading and minimal frictional contact between the blades and the upper annular end 12 of packer 14 which is to be cut away and removed. The blade design shown in the embodiment of FIGS. 1-6 comprises a plurality of generally identical L-shaped blades generally indicated at 32 and 34 arranged in alternate relation and spaced at 45° intervals about the periphery 24 of tool body 22. Blades 32 and 34 each has a vertical leg 35 extending vertically along the outer peripheral surface 24 of tool body 22 and a horizontal leg 37 extending horizontally beneath the lower end 30 of tool body 22. Blades 32, 34 are in a plane parallel to the longitudinal axis of rotation of tool 10 as shown in the drawings but could, if desired, be positioned in an angular or spiral position with respect to the axis of rotation to provide a desired axial or radial rake. Likewise, any desired number of blades could be provided about the periphery of the tool body.

Figure 5:
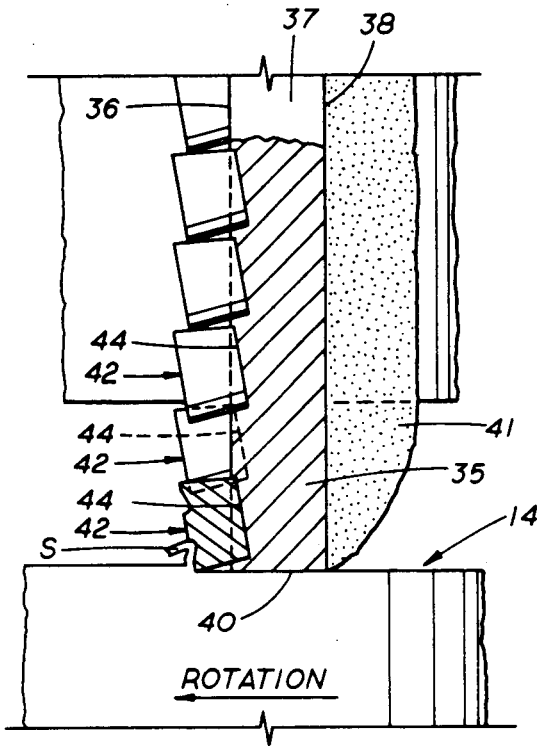
FIG. 5 is an enlarged fragmentary view of one of the blades showing one of the cutting elements mounted thereon with the lowermost cutting element engaging in the upper end of the packer and forming a metal turning thereon.

As shown particularly in FIG. 5, each blade 32, 34 has a base with a leading planar face or surface 36, an opposed trailing planar face or surface 38, and a lower wear surface 40 positioned between and at right angles to surfaces 36 and 38. Lower surface 40 is in contact with and rides along the upper annular end 12 of packer 14 which is being cut and removed during the cutting operation. Blades 32 and 34 are preferably secured by welding or brazing to peripheral surface 34 of tool body 22.

For reinforcing and strengthening blades 32, 34 particularly for conditions encountered during the cutting operation, an alloy backing material indicated at 41 is positioned on trailing face 38 and the adjacent peripheral surface 24 of tool body 22. Backing material 41 preferably comprises crushed tungsten carbide particles suspended in a matrix having a nickel silver content along with cobalt in a copper base material. Such a material has a high strength and aids in the cutting action upon wear of the associated blade.

Leading face 36 of each blade, 32, 34 has a plurality of hard carbide cutting elements generally indicated 42 of a predetermined size and shape mounted in a symmetrical pattern therein and preferably comprising a plurality of cylindrical carbide discs or buttons secured by suitable brazing or the like to planar face 36 of the base of blade 32. Cutting elements 42 are arranged in two transverse rows on horizontal leg 35 and the cutting elements in one transverse row are staggered horizontally or offset with respect to the cutting elements in the adjacent row thereby to provide different cutting paths. Further as shown particularly in FIG. 4, the cutting elements 42 on blades 32 are staggered horizontally with respect to cutting elements on blades 34. Thus the cutting elements on adjacent blades are in different concentric cutting paths to make different kerfs in the man-made object being cut away. Such an arrangement provides a relatively smooth uniform cutting action with minimal roughness during the cutting action. A single generally vertical column of cutting elements 42 is provided on vertical leg 37 radially outwardly of peripheral surface 24 of tool body 22.

A disc forming cutting element 42 which has been found to function in a satisfactory manner has a thickness of ¼th inch, a diameter of ⅜ths inch, and is sold by the Sandvik Company, located in Houston, Texas.

Figure 6:
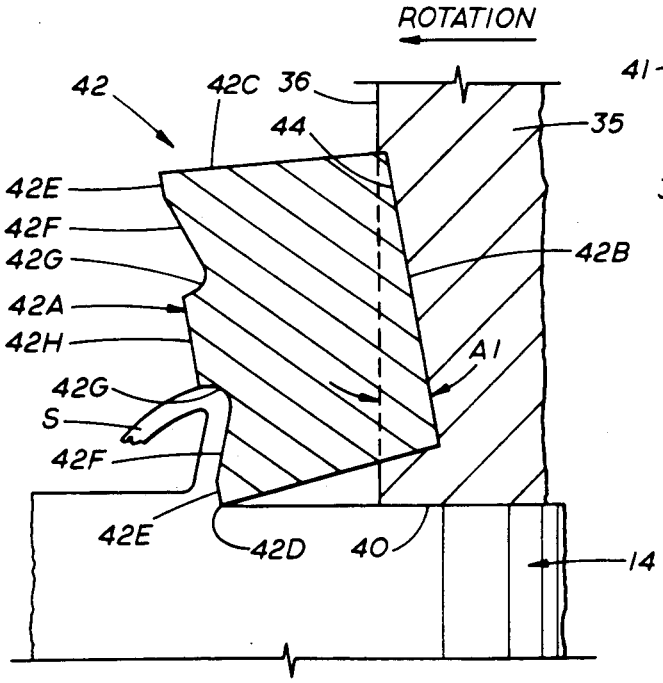
FIG. 6 is an enlarged fragment of FIG. 5 showing a single cutting element on the associated blade.

Each cutting element 42 as shown in FIG. 6 is formed of a generally frusto-conical shape having a generally planar front face 42A, a generally planar rear face 42B, and a frusto-conical peripheral surface 42C extending between faces 42A and 42B. A relative sharp edge 42D is formed at the juncture of peripheral surface 42C and front surface 42A. The relatively sharp circular cutting edge 42D as shown particularly in FIG. 6 has a lower semicircular section defining a lowermost intermediate portion and adjacent opposed side portions diverging upwardly from the lowermost intermediate portion for contacting in cutting relation the packer 14.

The generally planar front surface 42A includes an annular flat marginal surface portion 42E adjacent edge 42D for reinforcement of edge 42D, and an annular groove 42F tapering inwardly from the flat 42E to define a radius at 42G adjacent a circular center portion 42H of front face 42A. A metal cutting or shaving shown at S in FIG. 6 is received in and rides along tapered groove 42F with the extending end of metal shaving S being directed forwardly and downwardly by radius 42G to facilitate breaking of the metal shaving S from upper end 12 of packer 14. Leading face 42A has a negative axial rake angle formed at angle A1 with respect to the axis of rotation as shown in FIG. 6 as faces 42A and 42B are in parallel relation to each other. The inclination of face 42A in combination with the annular groove 42F and radius 42G formed thereby, assists in the breaking of the metal shavings S at a relatively short length of 1-3 inches, for example, and since a substantial thickness of shavings S is provided, the curling or turning up of the ends of the shavings is restricted, thereby to minimize internesting of the metal shavings to facilitate the removal of the turnings from the well bore.

For precisely positioning each cutting element 42 on blades 32, 34, leading surface 36 has a dimple or recess 44 formed therein to receive a respective cutting element 42. Recess 44 is of a relatively shallow depth for example, and defines a surface area slightly larger than the surface area of rear face 42B of cutting element 42 for receiving cutting element 42. Recesses 50 are angled vertically at angle A1 to provide the desired negative axial rake on cutting element 42 as faces 42A and 42B are n parallel planes, and are arranged in a predetermined pattern on leading surface 36 for receiving cutting elements 42. Cutting elements 42 are secured, such as by brazing, to surface 36 after elements 42 are positioned within recesses 44. The precise positioning of cutting elements 42 on surface 36 results in cutting elements 42 projecting a uniform distance from surface 36 with leading faces 42A being in parallel relation. Such a positioning results in a uniform and substantially equal loading of cutting elements 42 during the cutting operation.

Recesses 44 which define a bottom surface on which cutting elements 42 are seated may be provided with any desired axial or radial rake angle with respect to the longitudinal axis of rotation and leading faces 42A of the cutting elements 42 will have the same rake since parallel to the bottom surface. For example, the bottom surface of recess 44 may be angled rearwardly in a horizontal direction with respect to the radial plane of cutter body 22 to provide a negative radial rake. Also, if desired, the bottom surface of recess 44 could be angled horizontally forwardly with respect to the radial plane of cutter body 22 to provide a positive radial rake as might be desirable for the removal of softer material, such as aluminum or plastic tubular members. The use of a negative radial rake would tend to direct the metal cuttings outwardly of the object being cut whereas a positive radial rake would tend to direct the metal cuttings inwardly of the object being cut.

The rotational speed of cutting tool 10 is designed to provide a surface speed of blades 32, 34 along the upper annular surface 12 of packer 14 at an optimum of around three hundred (300) to three hundred and fifty (350) feet per minute in order to obtain an optimum cutting depth for each blade of around 0.004 inch. When operating at such a speed, a torque of around 2500 to 3000 foot pounds has been found to be satisfactory for rotation of cutting tool 10. A surface speed of between two hundred (200) and four hundred and fifty (450) feet per minute along surface 12 is believed to be satisfactory under certain conditions.

Figure 7:
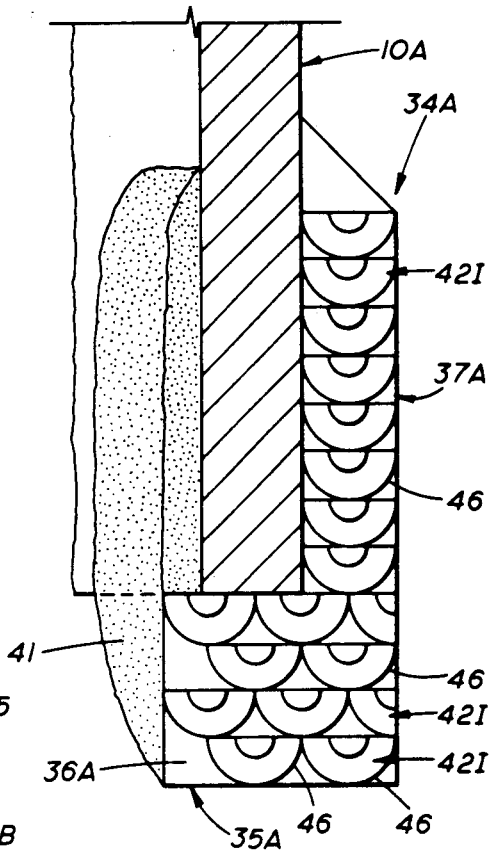
FIG. 7 is an embodiment of the blade shown in FIG. 1–6 with modified cutting elements of a semicircular shape mounted thereon.

Cutting elements for the blades may be formed of different sizes and shapes and yet result in an efficient and effective cutting operation if positioned in a predetermined pattern in generally side by side relation. FIG. 7 shows an embodiment of cutting elements 42I of a semi-circular shape positioned on leading face 36A of blade 34A. Sharp semi-circular edges shown at 46 for cutting elements 42I are continually presented to the upper annular end of packer 14 for the cutting of the packer. The semi-circular cutting elements 42I are arranged in four transversely extending rows on lower leg 35A of blade 34A and cutting elements 42I in adjacent rows are in horizontally staggered or offset relation so that different cutting paths are provided. Also, the cutting elements on adjacent blades for similar rows are in horizontally staggered relation so that the cutting elements on adjacent blades have different concentric paths for providing different kerfs in the object being removed.

Figure 8:
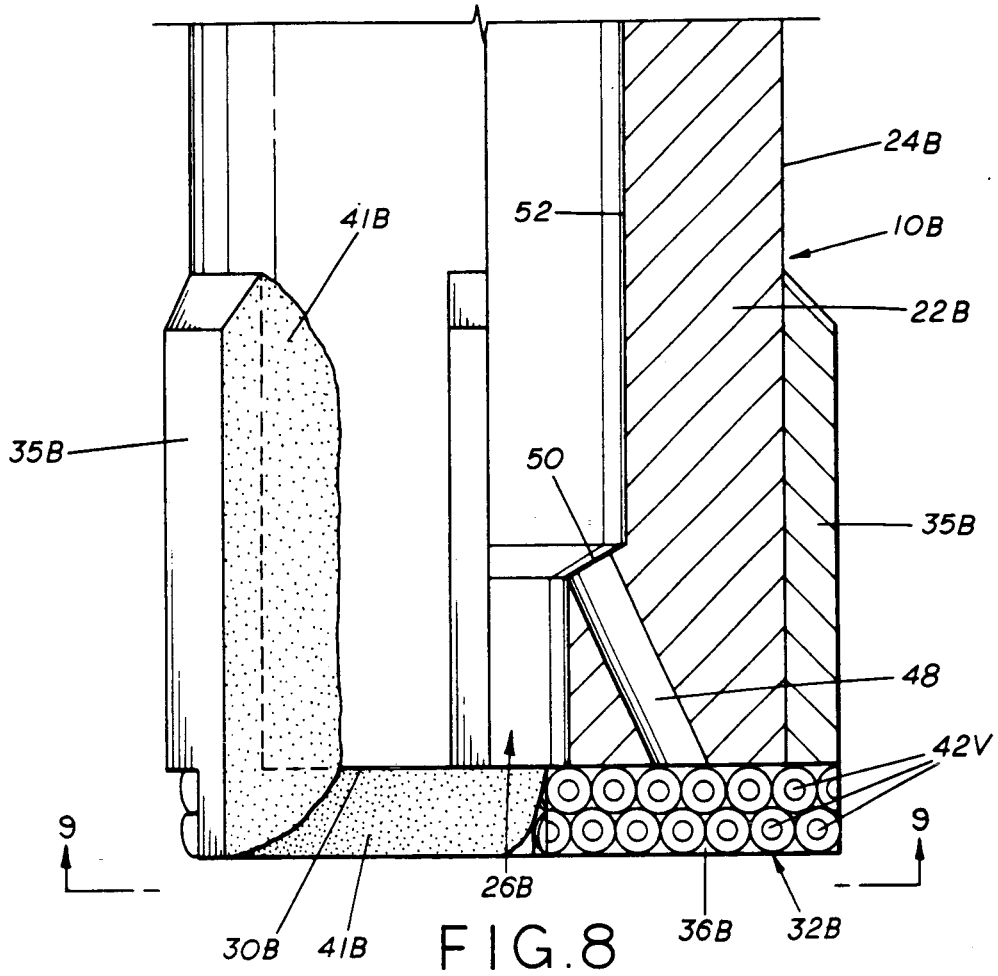
FIG. 8 is an enlarged elevational view of the lower end of a modified cutting tool showing blades thereon extending downwardly from the lower end of the cutting tool and radially inwardly to a position adjacent the longitudinal centerline of the tool body.
Figure 9:
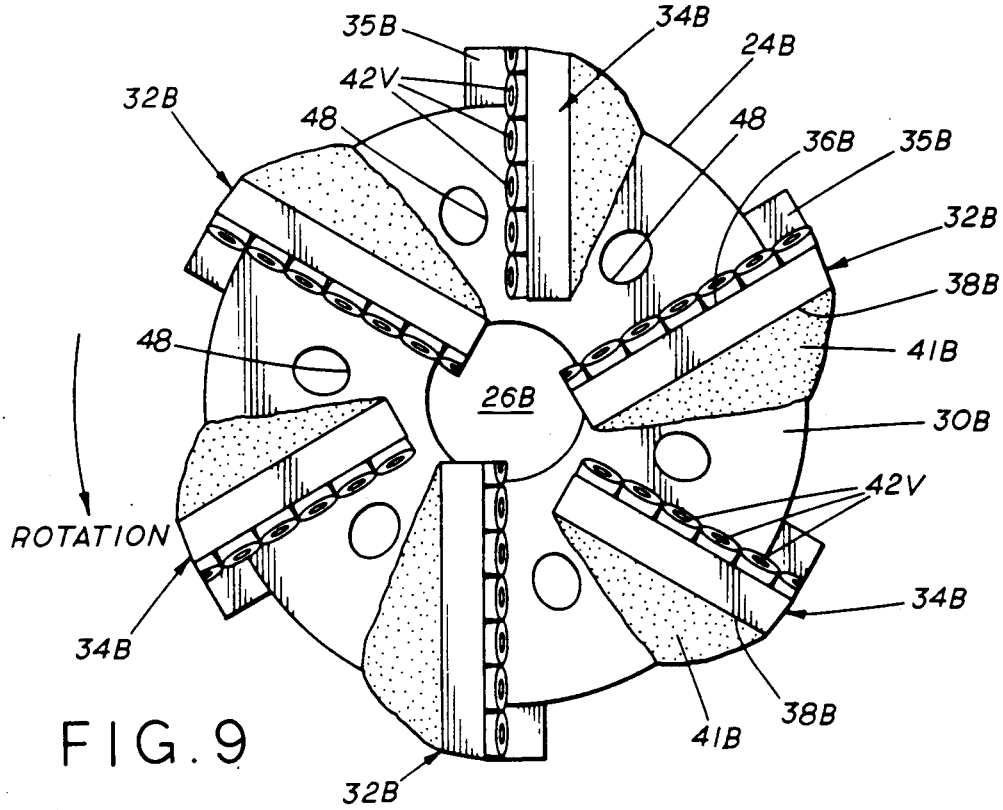
FIG. 9 is a bottom plan view of the modified cutting tool shown in FIG. 8 looking generally along line 9—9 of FIG. 8 and showing the arrangement of blades on the lower end of the cutting tool which comprises a so-called junk mill.

Referring to FIGS. 8 and 9, a modified cutting tool 10B is illustrated comprising a so-called junk mill particularly adapted for the removal of jammed tools in the well bore. Cutting tool 10B has a tool body 22B of a relatively large thickness and a relatively small diameter bore 26B defining an inner peripheral surface 28B. Blades 32B and 34B are positioned beneath the lower end 30B of tool body 22B and extend beyond the outer peripheral surface 24B. For reinforcing and strengthening blades 32B, 34B, a vertically extending reinforcing strip 35B is secured to the outer end portion of blades 32B, 34B and the outer peripheral surface 24B of tool body 22B. In addition, alloy material 41B is secured on the trailing surfaces 38B of blades 32B, 34B and bottom surface or end 30B of tool body 22B as well as the trailing surfaces of reinforcing strips 35B.

Cutting elements 42J which are similar to cutting elements 42 of the embodiment of FIGS. 1–6 are mounted in multiple transversely extending rows on the leading surface 36B of blades 32B, 34B with cutting elements 42J in one row staggered horizontally with respect to cutting elements 42J in the adjacent row. Likewise, cutting elements 42J in similar transverse rows in the same horizontal plane on adjacent blades are staggered so that the cutting elements 42J on adjacent blades have different concentric cutting paths and do not "track".

Blades 32B are of a transverse length greater than the transverse length of blades 34B in order to provide sufficient space between blades 32B and 34B for effective removal of the scrap material by drilling fluid. Further, fluid passages 48 in fluid communication with enlarged bore portion 52 of tool body 22B extend from a shoulder 50 formed in bore 26B between enlarged diameter bore portion 52 and small diameter bore portion 26B. Drilling fluid is discharged from end surface 30B of tool body 22B at a location between adjacent blades 32B and 34B. Thus, the scrap material is removed effectively by the drilling fluid returning to the surface through the annulus between the outer casing and the cutting tool.

Figure 10:
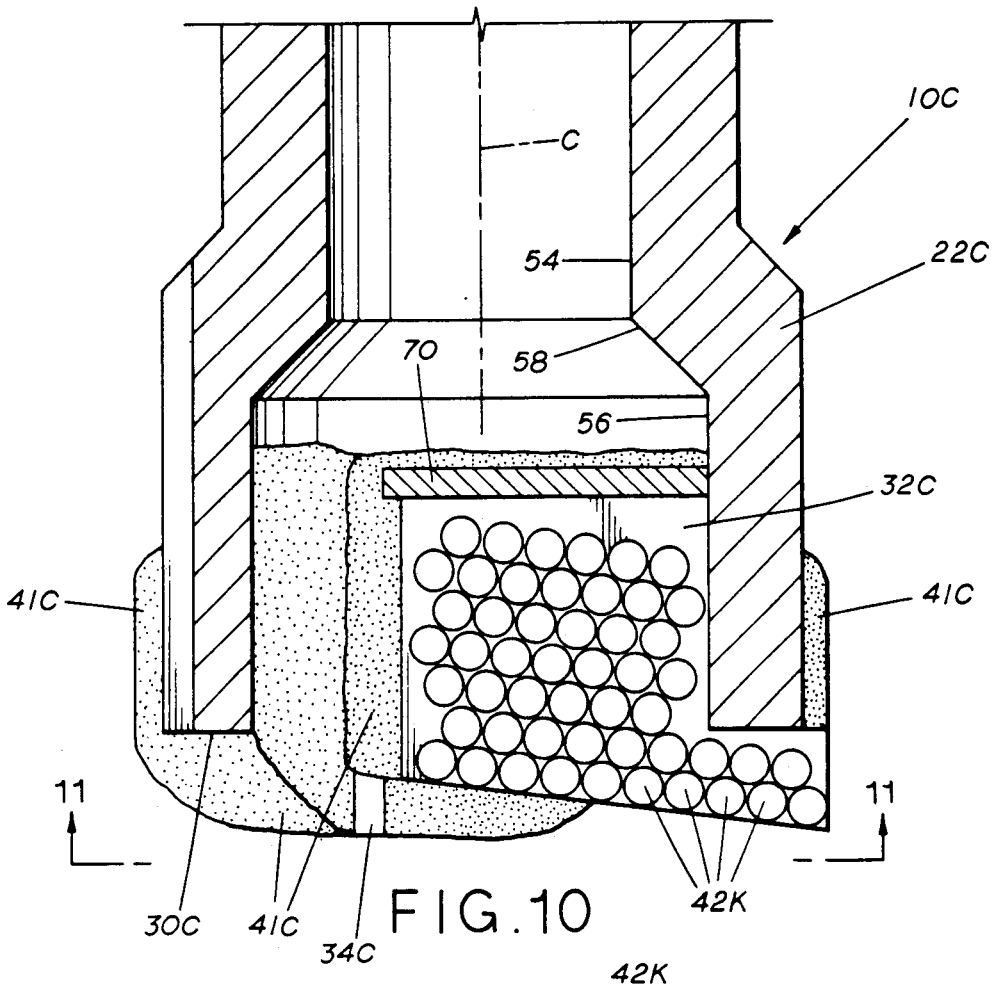
FIG. 10 is an enlarged sectional view of a lower end of a further modified cutting tool in which a relatively large wedge shaped blade extends radially inwardly past the longitudinal centerline of the tool body and is particularly adapted for cutting of cemented tubular members.
Figure 11:
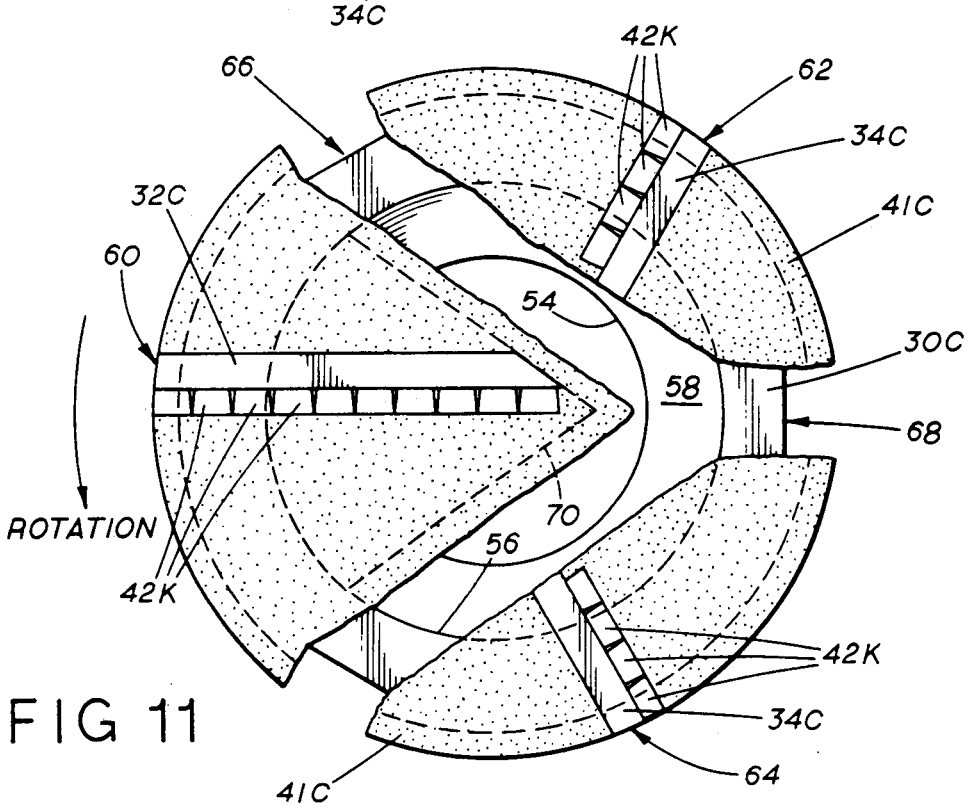
FIG. 11 is a bottom plan view of the embodiment of FIG. 10 taken generally along line 11—11 of FIG. 10.

Referring now to FIGS. 10 and 11, a further embodiment of a cutting tool is illustrated by cutting tool 10C which is particularly adapted for the removal of cemented tubular members. Cutting tool 10C has a tool body 22C defining an upper small diameter bore portion 54, a lower large diameter bore portion 56, and an inclined connecting shoulder 58 formed between bore portions 54 and 56. The longitudinal centerline is indicated at C and defines the axis of rotation for tool 10C. the lower annular end of tool 10C is shown at 30C and blades are indicated generally at 60, 62, and 64. Fluid passageways 66,68 between teeth 60,62 and 64 below lower end 30C provide for the flow of drilling fluid and scrap material outwardly to the annulus. Blade 60 is a relatively large blade which extends radially within large bore portion 54 past the longitudinal centerline C of tool 10C while blades 62 and 64 are relatively small blades which extend radially only partially within large bore portion 54.

Blade 60 includes a base support 32C extending in a generally vertical direction beneath lower end 30C of tool 10C and upwardly within enlarged end bore portion 56. An upper horizontal reinforcing plate 70 of a generally triangular shape is secured to the upper edge of support 32C and to the inner peripheral surface defined by enlarged bore portion 56. Cutting elements 42K are mounted on the leading face of support 32C. Alloy material 41C is secured to the trailing surface of support 32C and extends within bore portion 56 to reinforcing plate 70. Also, as indicated in FIG. 10, alloy material 41C extends along the outer surface of tool body 22C adjacent base support 32C.

Each blade 60, 62, 64 has a lower horizontal portion extending below the lower end 30C of tool 10C and at least one row of cutting elements 42K is mounted below lower end 30C of tool 10C. Small blades 62 and 64 have base supports 34C with cutting elements 42K mounted on the leading face of supports 34C. Alloy material 41C extends along the trailing faces of supports 34C within bore portion 41C and along the outer surface of tool 10C. Alloy material 41C assists cutting elements 42K in the cutting operation in addition to reinforcing supports 34C. However, under certain conditions, it may be desirable to increase the thickness of base supports 32C and 34C so that additional reinforcement from alloy material 41C would not be necessary. Alloy material 41C may be particularly useful, however, in the cutting action provided for the cemented portion of the metal tubular member being cut away.

Figure 12:
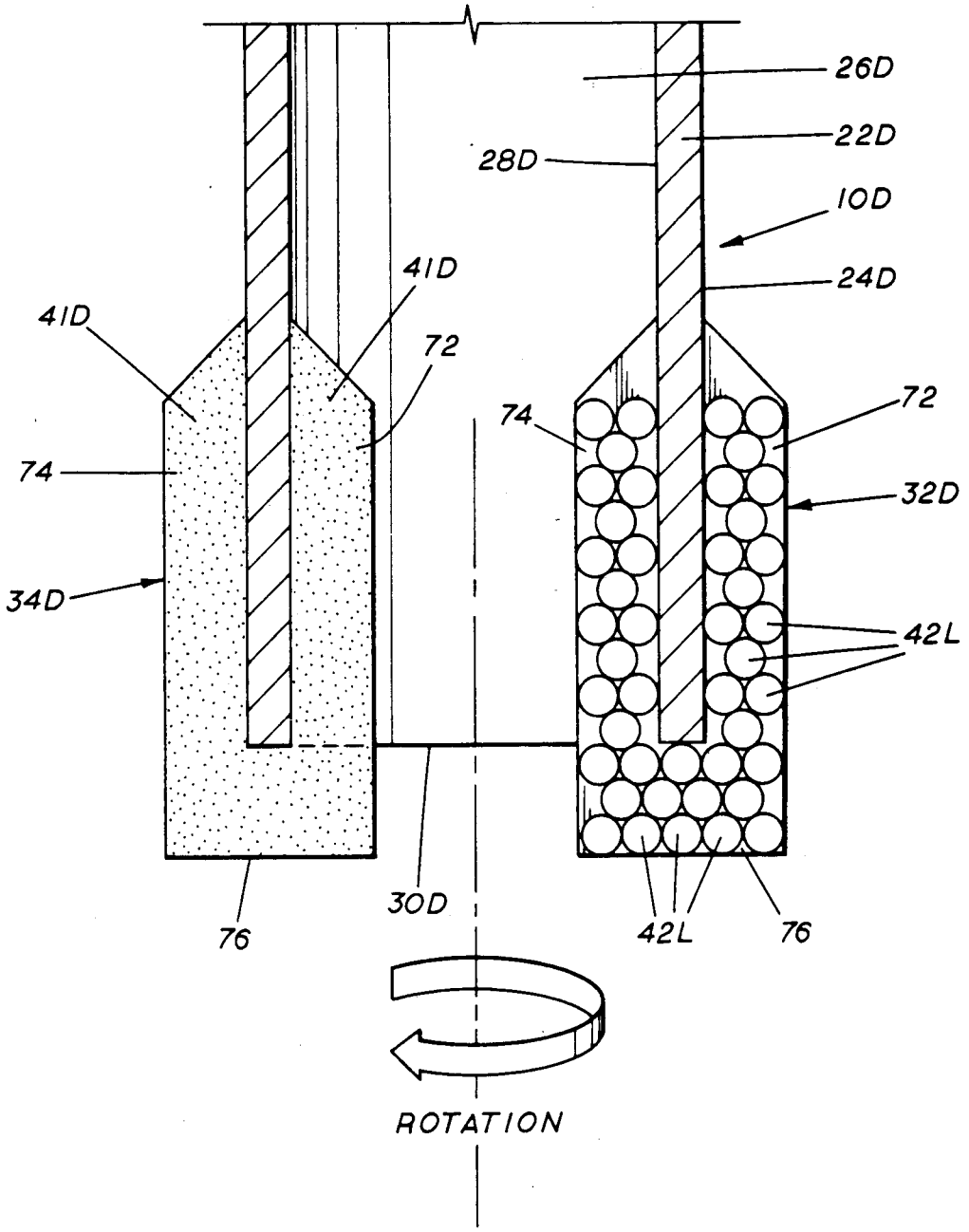
FIG. 12 is an enlarged sectional view of an additional embodiment of cutting tool in which cutting elements are provided along both the inner and outer surfaces of the tool body in addition to the lower blade.

FIG. 12 is a sectional view of a further modification of the cutting tool illustrating cutting elements extending radially both inside and outside the tool body in addition to extending downwardly from the lower end of the tool body. As illustrated, cutting tool 10D has a tool body 22D with central bore 26D defining an inner peripheral surface 28D and an outer peripheral surface 24D. The lower annular end of body 22D is shown at 30D.

Generally channel-shaped blades 32D and 34D are arranged in alternate relation to each other about the periphery of tool body 22D. Each channel-shaped blade 32D,34D has a pair of spaced inner and outer vertical legs indicated at 72 and 74 connected by a lower horizontal base or web 76. Legs 72 and 74 are secured to respective peripheral surfaces 24D and 28D of tool body 22D. Cutting elements 42L are secured to the leading faces of blades 32D and 34D. Suitable alloy material 41D is secured to the rear faces of blades 32D and 34D and the adjacent peripheral surfaces of tool body 22C.

From the above, it is apparent that the cutting or milling tool comprising the present invention and utilizing an improved blade design has been provided which increases the rate of penetration or rate of removal of an object or member cut away within an existing well to an amount that is three or four times greater than heretofore. By providing a cutting tool with such an improved blade design which results in an effective and fast removal rate of the metal scrap material from the well under the operational characteristics set forth, a highly improved result has been obtained.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a cutting tool adapted to be positioned down hole in a well bore for removing man-made members held in stationary position from the well bore;

a generally cylindrical tool body adapted to be received within said well bore and to be supported at its upper end for rotation about its longitudinal axis;

a plurality of blades at spaced intervals on the body extending downwardly from the lower end of the tool body and inwardly from the outer peripheral surface of the body, each of said blades having a base with a leading surface relative to the direction of rotation;

a plurality of closely spaced cutting elements of hard cutting material secured to said leading surface of the base each being of a predetermined size and shape and arranged in a predetermined pattern on the base relative to the other elements, each of said cutting elements having an exposed front cutting face forming a cutting surface, a rear face secured to the leading surface of said base, a peripheral surface extending between said faces, and a relatively sharp edge formed at the juncture of the front face and peripheral surface;

each of said blades having a pair of adjacent rows of cutting elements below the end of the tool body extending transversely of the tool body, the cutting elements on said adjacent rows being offset whereby the cutting elements on adjacent rows are adapted to cut concentric offset cutting paths, said cutting elements comprising cylindrical discs of a similar size and shape.

2. In a cutting tool as set forth in claim 1;

said blades extending radially inwardly below the lower end of said tool body and secured to said lower end.

3. In a cutting tool as set forth in claim 1;

said tool body having a central bore thereon and said blades extending upwardly within said central bore.

4. In a cutting tool as set forth in claim 1;

said blades extending upwardly along the outer periphery of said tool body.

5. In a cutting tool as set forth in claim 1;

said leading surface of said base having positioning marks thereon for said cutting elements for precisely positioning the cutting elements in said predetermined pattern.

6. In a cutting tool as set forth in claim 5;

said positioning marks comprising recesses on said leading surface of said blade to receive the rear faces of the associated cutting elements therein.

7. In a cutting tool as set forth in claim 6;

the recesses on said blades being arranged in transversely extending rows with the recesses on adjacent rows being staggered.

8. In a cutting tool as set forth in claim 7;

the depth of each of said recesses in a generally vertical direction progressively increasing from the upper end thereof thereby to provide a negative axial rake relative to the longitudinal axis of said tool body for cutting elements secured therein.

9. In a cutting tool as set forth in claim 1;

said blades being straight blades extending in a generally radial direction relative to the longitudinal axis of said body.

10. In a cutting tool as set forth in claim 1;

said cutting elements on corresponding rows of adjacent blades being staggered horizontally for following different concentric cutting paths.

11. In a cutting tool as set forth in claim 1;

each of said blades having a trailing surface with respect to the direction of rotation in opposed relation to said leading surface; and reinforcing means secured to said trailing surface and to said tool body for reinforcing and strengthening said blade.

12. In a cutting tool as set forth in claim 11;

said reinforcing means comprising crushed tungsten carbide chips embedded in a matrix of a powder metallurgy composite material and secured to said trailing surface of each blade.

13. In a cutting tool adapted to be positioned downhole in a well bore for removing man-made members held in stationary position from the well bore;

a generally cylindrical tool body adapted to be received within said well bore and to be supported at its upper end for rotation about its longitudinal axis;

a plurality of blades at spaced intervals on the body extending downwardly from the lower end of the tool body and inwardly from the outer peripheral surface of the body, each of said blades having a base with a leading surface relative to the direction of rotation;

a plurality of closely spaced cutting elements of hard cutting material secured to said leading surface of the base each being of a predetermined size and shape and arranged in a predetermined pattern on the base relative to the other elements, each of said cutting elements having an exposed front cutting face forming a cutting surface, a rear face secured to the leading surface of said base, a peripheral surface extending between said faces, and a relatively sharp edge formed at the juncture of the front face and peripheral surface;

said front face of each cutting element having a surface irregularity therein for directing a metal turning from the member being cut to effect a breaking of the metal turning;

each of said blades having a pair of adjacent rows of cutting elements below the end of the tool body extending transversely of the tool body, the cutting elements on said adjacent rows being offset whereby the cutting elements on adjacent rows are adapted to cut concentric offset cutting paths.

14. In a cutting tool as set forth in claim 13;

said irregularity in the front face of each cutting element comprises an annular groove tapering radially inwardly from the peripheral surface and terminating inwardly at an arcuate radius to receive an end of a metal turning and direct it forwardly with respect to the direction of rotation.

15. In a cutting tool as set forth in claim 13;

said irregularity elements being of a semi-circular shape arranged in transversely extending rows with the cutting elements in adjacent rows being staggered.

16. In a cutting tool adapted to be positioned downhole in a well bore for removing man-made members held in stationary position from the well bore;

a generally cylindrical tool body having a lower annular end surface and adapted to be supported at its upper end within said well bore for rotation about its longitudinal axis;

a plurality of cutting elements arcuately spaced in a generally circular path along and below the lower annular end surface of said tool body with said cutting elements projecting downwardly from said lower annular end surface, some of the cutting elements along the generally circular path being offset transversely from the remaining cutting elements so that different concentric cutting paths are provided by the cutting elements;

each of said cutting elements being of a predetermined size and shape and having an exposed front cutting face and a relatively sharp lower cutting edge, said lower cutting edge having a lowermost intermediate portion and adjacent opposed side portions diverging upwardly from said intermediate portion, said front face of each cutting element having a surface irregularity therein for directing a turning from said man-made members being cut to effect a breaking of the turning;

and means securing said cutting elements on said annular end surface in spaced relation along the generally circular path.

17. In a cutting tool as set forth in claim 16 wherein each of said cutting elements has a lower arcuate cutting edge.

18. In a cutting tool as set forth in claim 16 wherein said cutting elements comprise generally cylindrical discs.

19. In a cutting tool adapted to be positioned downhole in a well bore for removing tubular man-made metal members held in stationary position from the bore and to be connected to a drill string for receiving drilling fluid therefrom;

a tubular generally cylindrical tool body having a lower annular end surface and adapted to be supported at its upper end within said well bore by the drill string for rotation about its longitudinal axis and for discharge of drilling fluid from its lower end for removal of scrap material from the well bore;

a plurality of mounting means spaced at intervals in a generally circular path along said lower end surface of said tubular body and projecting downwardly from said lower annular end surface, each of said mounting means having a leading surface relative to the direction of rotation extending below said lower annular end surface;

at least two longitudinally spaced transversely extending rows of cutting elements mounted on said leading surface of each mounting means in closely spaced relation to each other below said annular end surface, each of said transversely extending rows having at least two cutting elements therein in closely spaced side by side relation;

each of said cutting elements being of a predetermined similar size and shape and arranged in a predetermined pattern relative to the other cutting elements, each of said cutting elements having an exposed front cutting face forming a cutting surface, a rear face secured to said leading surface of said mounting means, a peripheral surface extending between said faces, and a relatively sharp lower cutting edge formed at the juncture of said front face and peripheral surface, the front faces and associated cutting edges of the lowermost row of cutting elements defining a lower generally continuous cutting surface which is progressively worn away during the cutting operation with the next successive row of cutting elements then engaging the tubular metal member in a cutting operation.

20. In a cutting tool as set forth in claim 19 wherein the front face of each cutting element is arranged and constructed to direct a metal turning from the tubular metal member being cut to effect a predetermined breaking of the metal turning.

21. In a cutting tool as set forth in claim 20 wherein said lower cutting edge of each cutting element is of an arcuate shape.

* * * * *